US005497896A

United States Patent [19]

Shand

[11] Patent Number: 5,497,896

[45] Date of Patent: Mar. 12, 1996

[54] CONTAINER OPENER WITH EXTENDABLE MEMBER

[76] Inventor: Ronnie A. Shand, 7067 Windward Way, Apt. 195, Cincinnati, Ohio 45241

[21] Appl. No.: 354,362

[22] Filed: Dec. 12, 1994

[51] Int. Cl.[6] ..... B65D 17/34

[52] U.S. Cl. ..... 220/269; 220/270; 220/906

[58] Field of Search ..... 220/269, 270, 220/906; 413/14, 16, 25; 81/3.46, 3.55, 3.56, 3.57

[56] References Cited

U.S. PATENT DOCUMENTS

| | | | |
|---|---|---|---|
| 1,324,455 | 12/1919 | Lefevre | 220/285 |
| 3,977,561 | 8/1976 | Strobe et al. | 220/906 X |
| 4,872,597 | 10/1989 | Hanafusa | 220/269 X |
| 4,873,896 | 10/1989 | Hull | 81/3.55 X |
| 4,901,877 | 2/1990 | Hall | 220/269 X |

*Primary Examiner*—Allan N. Shoap
*Assistant Examiner*—Robin A. Hylton
*Attorney, Agent, or Firm*—Leatherwood Walker Todd & Mann

[57] ABSTRACT

A container opener for use with a container top having a depressible closure member. A first member is connected to the container top adjacent the closure member. Movably connected to the first member is a second member which may be moved outwardly from the top of the can by pivoting or sliding such that a portion of the second member extends beyond the edge of the can. A fastener is provided which allows lateral movement of the second member with respect to the first member, but fixes upward movement of the second member with respect to the first member such that the first and second members move together when the second member is lifted, thereby increasing the available leverage for opening the can.

19 Claims, 4 Drawing Sheets

Fig. 6.
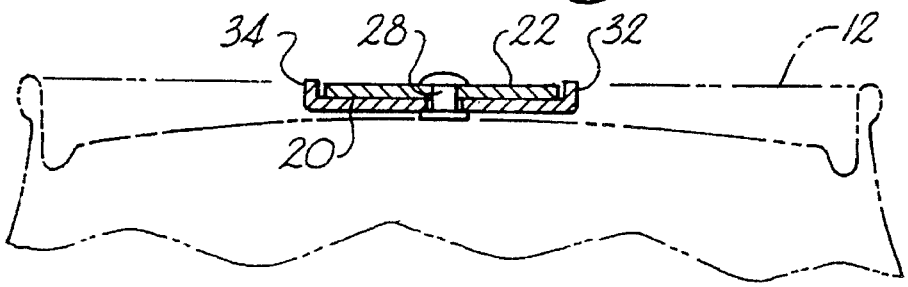
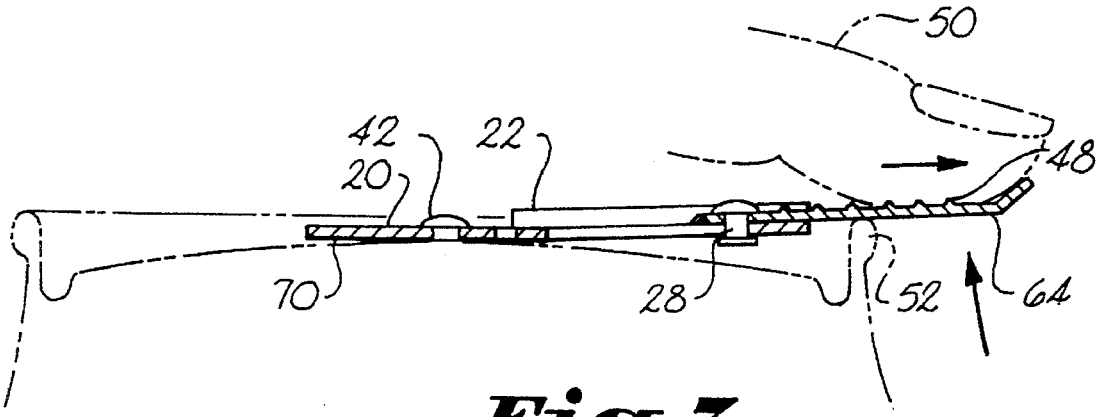
Fig. 7.
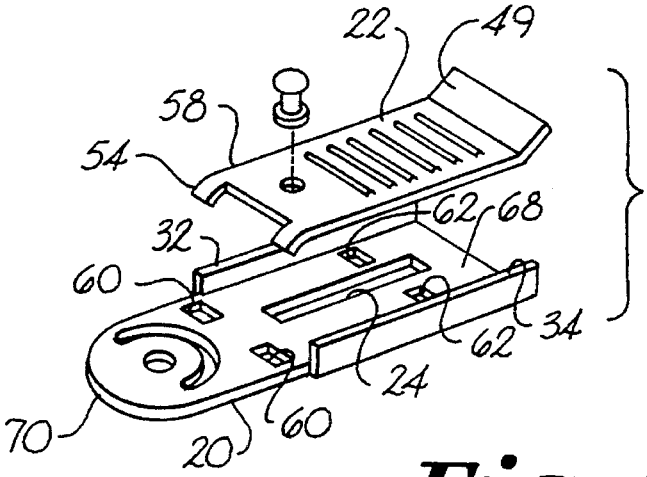
Fig. 5.

Fig. 8.
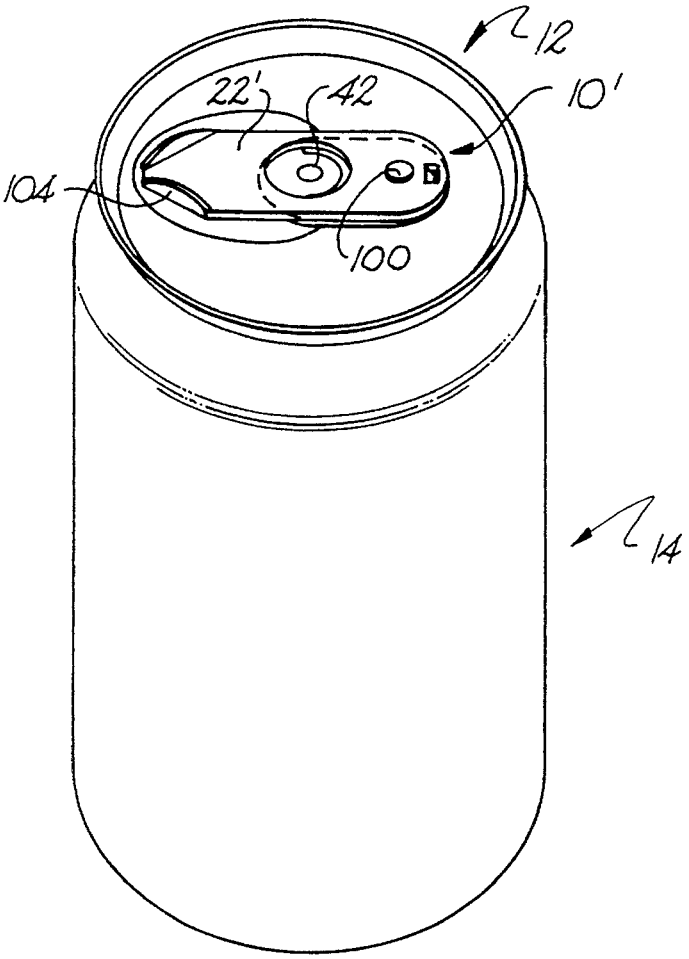
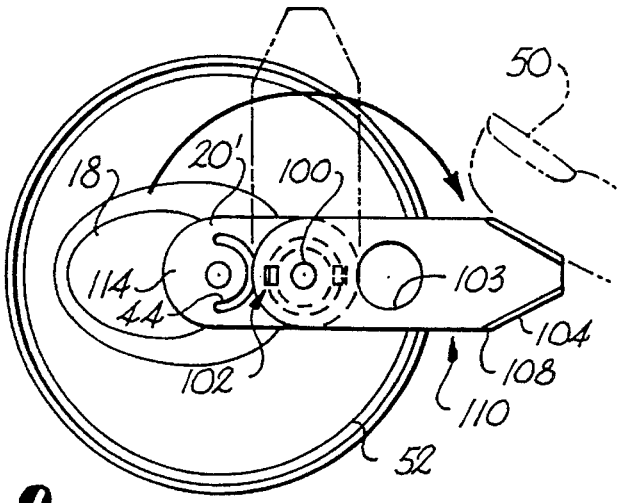
Fig. 9.

CONTAINER OPENER WITH EXTENDABLE MEMBER

BACKGROUND OF THE INVENTION

This invention relates generally to an improved container opening device.

Cans with "pop-top"-type closures have been on the market for a number of years. Pop-top cans find widespread use for soft drink and beer cans, but can also be used in other applications, such as for medications, lubricants, diet supplements, and the like. Such a closure design typically includes an end plate or cap which includes a partially severable closure member, or, "knock-out". The knock-out is defined by a scored line which typically substantially encircles the knock-out portion, except for a small portion which acts as a hinge. The hinge prevents the knock-out portion from becoming completely severed from the cap and falling into the can. This design has likely enjoyed popularity because no separate can opener is required for opening the can, and also, there are no members which must be detached from the can and discarded, such as was the case with a former pop-top design, wherein the pop-top was pulled from the can using a pull tab and then discarded. The former design potentially gave rise to safety concerns as the pull tabs could, through sharp edges, inflict injury. That design also gave rise to environmental concerns, as the pull tabs were more likely to be the subject of litter.

Although the present pop-top designs eliminate the need for a separate can opener or for detachable parts, they still offer limitations in allowing easy opening of a container. For example, some people may find it difficult to get their fingertip under the pop-top opening lever, and also, even if access can be gained with the fingertip or thumb, some people may find it difficult to impart enough leverage on the lever to depress the knock-out portion to open the can.

Special tools may be used which can be inserted under the tab and which pry the tab upwardly for opening. For example, U.S. Pat. No. 4,681,358, issued to Smith, discloses a device which is separate from a can and which acts as a tool to aid in the opening of conventional pop-top cans. Likewise, U.S. Pat. No. 4,660,446, issued to Soltis, discloses another separate can top opener tool. Other types of such separate tools are disclosed in U.S. Pat. No. 4,967,622, issued to Phillips, and U.S. Pat. No. 4,723,465, issued to Hughes.

Similarly, other can opener tools are disclosed in U.S. Pat. Nos. 4,455,895, issued to Christensen; 5,095,777, issued to Osmar, et al.; and 4,745,829, issued to VanHoutte, et al.

U.S. Pat. No. 5,248,053, issued to Lundgren, discloses a variation of the conventional pop-top design, wherein the tab, or operating lever, pivots upwardly on an inclined plane formed in the top of the can in order to raise the end of the lever to a position which allows for easier access of the person's fingers beneath the lever.

While the foregoing designs are known, there still exists a need for a container opener which eases the opening of a container and which offers improved access to the user's fingers and also an increase in available leverage. Such a container design would preferably be of simple and economical design necessary for commercial success and would also be environmentally acceptable through an absence of detachable, throw-away components.

SUMMARY OF THE INVENTION

It is, therefore, the principal object of the present invention to provide a container closure opening device which facilitates the opening of a container.

It is another object of the present invention to provide a container opening device having a portion which extends over the edge of the container.

It is another object of the present invention to provide a container opening device having a member which pivots or slides outwardly over the edge of the container for allowing access thereto.

It is still another object of the present invention to provide a container opening device having increased leverage.

It is still another object of the present invention to provide a container opening device moveable between a retracted position and an extended opening position.

It is a further object of the present invention to provide a container opening device having a moveable member with upturned portions for engagement by the user's finger.

It is still further an object of the present invention to provide a method for using a container opening device constructed in accordance with the present invention.

It is an additional object of the present invention to provide a method for assembling a container opener constructed in accordance with the present invention.

A yet further object of the present invention is to provide a container opening device having locking members for locking a moveable member in a pre-determined position.

Generally, the present invention includes an opening device for opening a container closure member, the container having an edge portion, the opening device comprising a first member fixedly attached to the container adjacent the closure member and a second longitudinally extending member connected to the first member for movement relative to the first member. The second member is moveable with respect to the first member between a retracted position, within the edge portion of the container, to an extended position, wherein at least a portion of the second member extends beyond the edge portion of the container, such that upon the portion of the second member which extends beyond the edge portion being lifted, a portion of the first member forces the container closure member downward to an open position.

More specifically, the opening device of the present invention includes the second member being either pivotally or slidingly connected to the first member for extension beyond the edge of the container, thereby lengthening the effective lever formed by the first and second members in use in forcing the closure member open.

The present invention also includes a method of assembling the opening device of the present invention together with a container closure member, and also a method of operating the opening device to provide an elongated opening lever accessible beyond the edge of a container.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which:

FIG. 5 is an exploded view of a container opening device constructed in accordance with the present invention;

FIG. 6 is a sectional view of a container opening device constructed in accordance with the present invention;

FIG. 7 is a sectional view taken along lines 7—7 of FIG. 2;

FIG. 8 is a perspective view of an alternate embodiment of a container opening device constructed in accordance with the present invention; and FIG. 9 is a plan view of the alternate embodiment illustrated in FIG. 8.

DESCRIPTION OF THE PREFERRED EMBODIMENT

Figure 1:
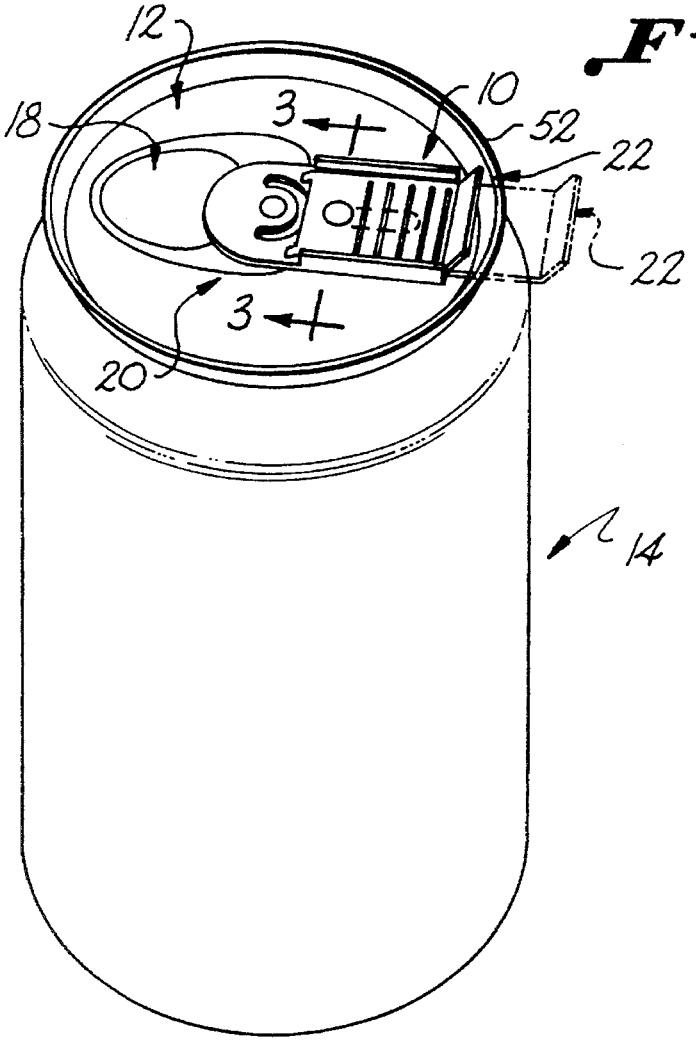
FIG. 1 is a perspective view of a container having a container opening device constructed in accordance with the present invention.

The accompanying drawings and the description which follows set forth this invention in its preferred embodiment. However, it contemplated that persons generally familiar with container closures and opening devices will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the container opener of the present invention is indicated generally in the figures by reference character 10.

Figure 2:
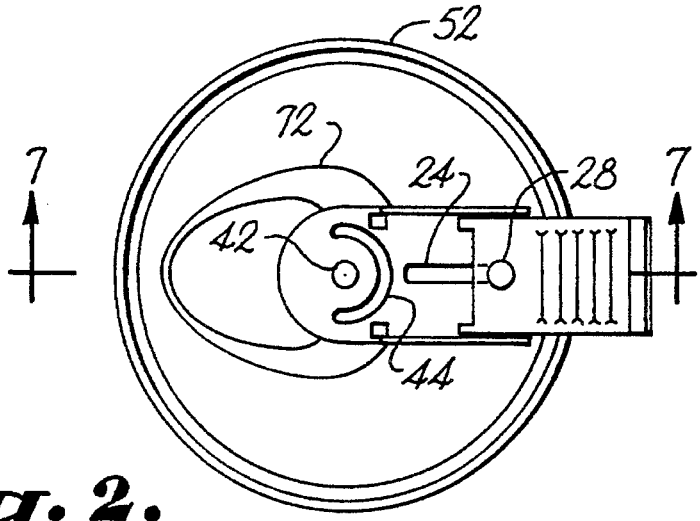
FIG. 2 is a plan view of a container opening device constructed in accordance with the present invention.

Turning now to FIGS. 1 and 2, a container opener 10 constructed in accordance with the present invention, is illustrated. Container opener 10 is shown connected to the top, generally 12, of a container, generally 14. A container closure member, or "knock-out", generally 18, is provided in the top 12. Container 14, as illustrated, is a beverage can which could be used for soft drinks and/or alcoholic beverages or for other liquids, gels, or powders, etc. It is to be understood, however, that container opener 10 is not to be limited to conventional drink containers, but could be used for other type of containers wherein contents are to be dispensed through an opening formed by displacement of a yieldable closure member. For example, container opener 10 could be used on containers carrying lubricants, fuels, medications, paints, chemicals, etc.

Figure 3:
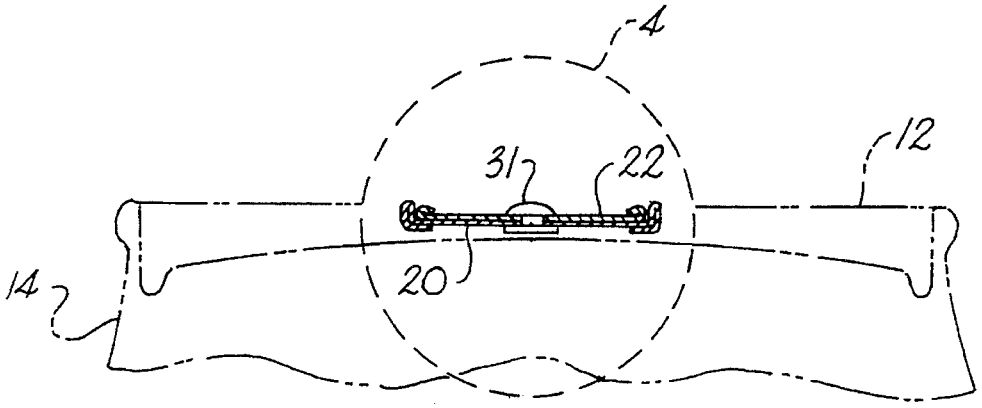
FIG. 3 is sectional view taken along lines 3—3 of FIG. 1.
Figure 4:
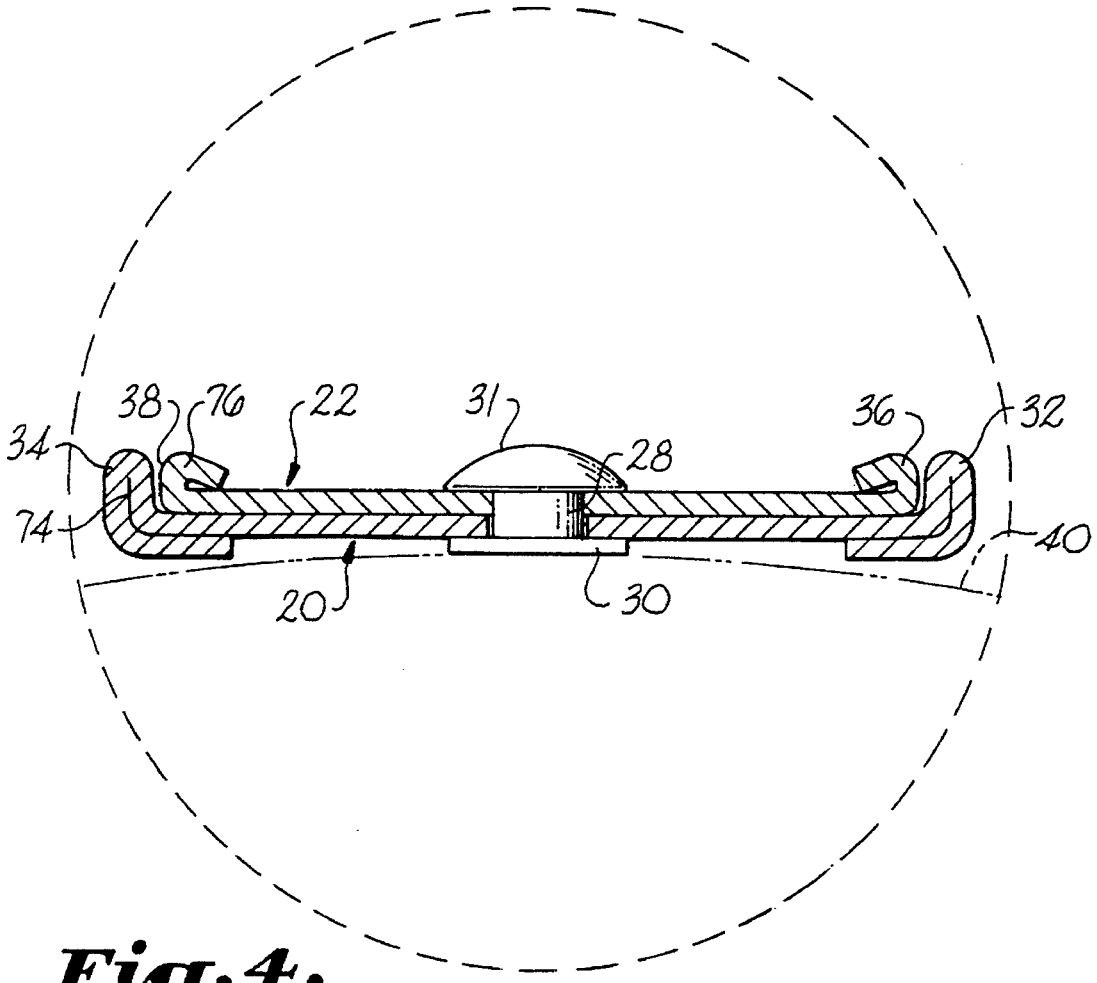
FIG. 4 is an enlarged view of the portion circled in FIG. 3.

Container opener 10 includes a lower tab, generally 20, and an upper tab, generally 22. Lower tab 20 is preferably elongated and includes a longitudinally extending slot, or, track 24 provided therein. Upper tab 22 includes a rivet, or, post 28, which extends downwardly from upper tab and through slot 24. As shown in FIGS. 3 and 4, the lower portion of post 28 includes an enlarged portion 30 which prevents removal of upper tab from lower tab and which also substantially fixes upper and lower tabs 20, 22 against relative vertical displacement. The upper end of post 28 includes an enlarged head portion 31 for retaining upper tab 22 to lower tab 20.

Upper tab 22 slides in relation to lower tab 20 in a substantially rectilinearly manner through engagement of post 28 and slot 24. It is to be understood, however, that post 28 could be provided in lower tab 20 and could extend upwardly therefrom, and slot 24 could be defined in upper tab 22 for sliding engagement with post 28, if desired. Also, although a post and slot arrangement has been illustrated for allowing slotting movement of upper tab 22 with respect to lower tab 20, a variety of other sliding engagement configurations could be used. For example, instead of one slot and one post being used, two or more slots with cooperating posts (not shown) could also be used. Cooperating channel members (not shown) could also be used wherein one tab would have a longitudinal channel of one configuration for mating receipt by a longitudinally extending channel provided on the other tab.

Lower tab 20 is also provided with side guide rails 32, 34 which assist in the rectilinear movement of the upper tab 22 with respect to lower tab 20. Side rails 32, 34 act as guide surfaces for engagement with edge portions 36, 38 of upper tab 22, respectively.

Lower tab 20 is connected to container cap 40 through a press fit arrangement on a rivet or nipple 42 provided on cap 40. A semicircular slot 44 may also be provided in lower tab 20 to allow pivoting and flexure of lower tab 20 during opening of container 14 in a manner to be discussed in more detail below.

Upper tab 22 preferably includes a series of ridges, undulations, or slots, generally 48, and an upturned end 49 in order to improve the purchase of a user's fingers 50 on upper tab 22 in advancing upper tab 22 between a retracted position within the rim, or edge 52 of cap 40, as illustrated in FIG. 1, and an extended position, wherein a portion of upper tab 22 extends outwardly beyond rim 52 of container 14 as illustrated in FIG. 2.

Locking means may also be optionally provided for selectively locking upper tab 22 with respect to lower tab 20 in desired positions. Downwardly extending flanges, or catches 54, are provided on the trailing end 58 of upper tab 22 for engagement with depressions, or, slots 60, 62 provided in lower tab 20. During transport of containers 14 and during storage, catches 54 would preferably engage recesses 60 of lower tab 20 to retain upper tab 22 in the retracted position. When it is desired to open the container, upper tab 22 would be moved outwardly with the user's finger to the point where flanges 54 engage slots 62 of a lower tab 20, thereby locking upper tab 22 in an extended position. Flanges 54 and recesses 60, 62 can be provided optionally, if desired, although they are not necessary for operation of container opener 10.

During operation of the present container opener 10, upper tab 22 is moved outwardly from its retracted position by the user engaging portions 48, 49 and forcing upper tab 22 outwardly until a portion 64 of upper tab 22 extends outwardly above and beyond the rim of container 14. Portion 64 is thus readily accessible by the user's thumb, fingers, palm, etc. The user would then lift upwardly on portion 64 when it is desired to open the can. By pressing upwardly on portion 64, upper tab 22 causes a concurrent upward lifting of forward portion 68 of lower tab 20 which in turn causes a downward movement of rearward portion 70 of lower tab 20, which is on the opposite side of rivet 42, with rivet 42 acting as a fulcrum, and the combination of lower and upper tabs 20, 22 act as an elongated lever to deliver increased force against knock-out 18 by rearward end 70 of lower tab 20. Continued lifting of portion 64 of upper tab 22 should cause sufficient downward force to be delivered against knock-out 18 to cause knock-out 18 to break away from cap 40 along the scored portion 72 which defined knock-out 18.

Knock-out 18 is preferably not scored entirely about its periphery, but only a substantial portion such that knock-out 18 remains hinged to cap 40 and does not separate therefrom during opening.

As illustrated in FIGS. 3 and 4, lower and upper tabs 20, 22 may be constructed of sheet aluminum, steel, or the like, and may have doubled over edge portions 74, 76, respectively. Alternately, lower and upper tabs 20, 22 could be formed from aluminum, steel, or other material without having such double over ends 74, 76, if desired.

An alternate embodiment of a container opener constructed with the present invention is illustrated in FIGS. 8 and 9 and is designed generally by the reference numeral 10'. Container opener 10' includes an upper tab 22' and a lower tab 20'. Lower tab 20' is preferably connected to cap 40 of container 14 in similar fashion as discussed above and also may include semicircular slot 44, if desired. However, instead of upper tab 22' sliding substantially rectilinearly with respect to lower tab 20', upper tab 22' pivots outwardly above and beyond the edge 52 of container 14 during the opening procedure. As shown in FIG. 8, upper tab 22' is in a retracted position partially covering knock-out 18. Upper tab 22' is pivotally connected to lower tab by a rivet, or, post 100 which connects the two tabs 20', 22' together.

Locking means, which may include detent portions, generally 102, may be provided on upper tab and/or lower tab 20', 22' in order to facilitate upper tab 22' remaining in position within the edge portions of container 14 during packing, shipping, storage, etc. The cooperating detent portions 102 could include downwardly extending projections provided on upper tab 22' for engagement with recesses provided in lower tab 20', or vice versa. Upstanding portions, or, ears 104 can be provided adjacent one end 108 of upper tab 22' to aid the user in making contact with the upper tab with his or her fingers during movement of the upper tab from a retracted position shown in FIG. 8 to the extended position, as shown in FIG. 9, wherein a portion, generally 110, of upper tab 22' extends outwardly from the edge of container 14. Detents 102 could also be provided for locking upper member 22' in the extended position, or at intermediate positions between the retracted and intermediate positions, if desired.

An access opening 103 can also be provided in upper tab 22' to allow access to rivet 42 when tab 22' is in a retracted position, thereby allowing tabs 20', 22' to be pre-assembled as a unit, together with rivet 100, and then subsequently attached to cap 40.

During operation of the alternate embodiment container opener 10', upper tab 22' is rotated through engagement of the user's fingers with ears 104 and rotated outwardly to the extended position. Once in the extended position, the upper tab 22' is lifted upwardly, which through connection with lower tab 20' causes the rearward end 114 of lower tab 20' to move downwardly about nipple or rivet 42, thereby exerting pressure on knock-out 18. Further upward movement of portion 110 of upper tab 22' causes sufficient force to be placed against knock-out 18 by end 114 of the lower tab, such that knock-out 18 breaks away from cap 40 and is depressed downwardly into the container, thereby opening container 14 and allowing access to its contents.

During manufacture, the upper tab of either of the container opener's 10, 10' may be attached to the lower tabs to form a subassembly. That subassembly is then preferably attached to the top of the container. However, it is to be understood that other manufacturing methods could also be used, if desired, or depending on available equipment and resources.

From the foregoing, it can be seen that a container opener constructed in accordance with the present invention offers increased leverage for opening a can and also allows improved access to the user, since the lever arm of the present invention, formed from a combination of the upper and lower tabs, extends outwardly beyond the edge of a container, thereby allowing much improved access to the user in exercising the increased leverage available. Further, because of the retracted positions afforded by the present container opener, containers having the present openers may be packaged, stored, shipped, stacked, as are conventional containers. Further, the container opener of the present invention affords greater ease in opening of a container, without the requirement of additional, separate tools, and without producing detachable members which could potentially pose undesirable health and environmental effects.

A further embodiment (not shown) of the present invention, could potentially involve rivet 42 acting as a first tab, with a larger, elongated version of an upper tab being used. Such an upper tab would include a slot longer than slot 24, to allow movement of the upper tab such that a portion of the upper tab extends beyond the edge of the container, and would also include an end portion for allowing the upper tab to simultaneously engage and depress the knock-out 18 downwardly for opening container 14.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. An opening device for opening a container closure member, the container having an edge portion, the opening device comprising:

a first longitudinally extending member fixedly attached to the container adjacent the closure member; and a second longitudinally extending member connected to said first member fore movement relative to said first member; said second member being moveable with respect to said first member between a retracted position, within the edge portion of the container, to an extended position, wherein at least a portion of said second member extends radially outwardly beyond the edge portion of the container such that upon said portion of said second member being lifted, said first member is forced downwardly for opening the container closure member.

2. An opening device as defined in claim 1, wherein said first member extends longitudinally, and wherein said second member moves in a plane substantially parallel to said first member when moving between said retracted and extended positions.

3. An opening device as defined in claim 1, further comprising a pivotal connector connecting said first and second members together and for allowing pivotal movement of said second member with respect to said first member when said second member is moved between said retracted and extended positions.

4. An opening device as defined in claim 1, further comprising upstanding portions connected to said second member for contact by a user during movement of said second member with respect to said first member.

5. An opening device as defined in claim 1, further comprising locking means associated with said first member and said second member for substantially fixing said second member with respect to said first member in a predetermined position.

6. An opening device as defined in claim 1, further comprising:

a fastener connecting said first member to the container; and said second member defining an access opening for allowing access to said fastener through said second member.

7. An opening device as defined in claim 1, wherein said second member defines engagement portions for engagement by the user when moving said second member between said retracted and extended positions.

8. An opening device as defined in claim 1, wherein said second member moves substantially rectilinearly with respect to said first member when said second member is moved between said retracted and extended positions.

9. An opening device as defined in claim 8, wherein said second member includes at least one guide member for guiding movement of said second member with respect to said first member when said second member moves between said retracted and extended positions.

10. An opening device as defined in claim 8, further comprising a track defined in one of said first and second members and an engagement member defined in the other of said first and second members for engagement with said track when said second member is moved between said retracted and extended positions.

11. An opening device as defined in claim 8, wherein said first member defines a longitudinally extending track and said second member includes a downwardly extending engagement member for engaging with said track when said second member is moved between said retracted and extended positions; said engagement member also fixing at least one end of said second member from substantial vertical movement with respect to said first member.

12. An opening device for opening a container closure member, the container having an edge portion, the opening device comprising:

an attachment member fixedly attached to the container adjacent the closure member; and a longitudinally extending lever connected to said attachment member; said lever being moveable with respect to said attachment member between a retracted position, within the edge portion of the container, to an extended position, wherein said lever extends radially outwardly beyond the edge portion of the container such that upon said lever being lifted, said container closure member is forced downwardly for opening the container.

13. An opening device as defined in claim 12, wherein said longitudinally extending lever includes a first member connected to said attachment member and a longitudinally extending second member movably connected to said first member, and further comprising a pivotal connector connecting said first and second member together and for allowing pivotal movement of said second member with respect to said first member.

14. An opening device as defined in claim 12, wherein said longitudinally extending lever includes a first member connected to said attachment member and a longitudinally extending second member movably connected to said first member, and wherein said second member moves in a plane substantially parallel to said first member.

15. An opening device as defined in claim 14, further comprising a sliding connector connected to said first and second members and wherein said second member is movable substantially rectilinearly with respect to said first member.

16. A method of assembling an opening device for opening a container closure member, the container having an edge portion, the method comprising:

providing a first member for attachment to the container;

providing a second member for movement relative to said first member radially outwardly beyond the edge portion of the container;

fixedly attaching said second member to said first member for substantially parallel movement relative to said first member; and connecting said first member to the container adjacent the container closure member.

17. A method of opening a container, the container having a container closure member and an edge portion, the method comprising:

providing a first member connected to the container adjacent the closure member;

providing a second member fixedly attached and movably connected to said first member;

moving a portion of said second member radially outwardly beyond the edge portion of the container; and lifting said portion of said second member upwardly such that said first member moves downwardly for depressing the closure member in opening the container.

18. A method as defined in claim 17, wherein said moving of said second member with respect to said first member includes pivoting said second member with respect to said first member.

19. A method as defined in claim 17, wherein said moving of said second member with respect to said first member includes moving said second member substantially rectilinearly with respect to said first member.

* * * * *